US005645499A

United States Patent [19]

Lewis

[11] Patent Number: 5,645,499

[45] Date of Patent: Jul. 8, 1997

[54] GOLFWRITE STATISTICAL ANALYSIS

[76] Inventor: Bob Lewis, P.O. Drawer 740849, New Orleans, La. 70174

[21] Appl. No.: 543,369

[22] Filed: Oct. 16, 1995

[51] Int. Cl.[6] ..... A63B 67/02

[52] U.S. Cl. ..... 473/407; 434/252

[58] Field of Search ..... 473/150, 168, 473/169, 407, DIG. 26; 434/252

[56] References Cited

U.S. PATENT DOCUMENTS

| | | | |
|---|---|---|---|
| 3,552,290 | 1/1971 | Brechtel | 473/407 |
| 3,949,987 | 4/1976 | Candor | 473/407 |
| 4,655,451 | 4/1987 | Townsley | 473/407 |
| 4,666,157 | 5/1987 | Bodine et al. | 473/407 |
| 4,783,071 | 11/1988 | Tattershall | 473/407 |

*Primary Examiner*—Steven B. Wong
*Attorney, Agent, or Firm*—Joseph T. Regard, Ltd.

[57] ABSTRACT

A golf practicing aid and its method of use which includes written and graphic indicia in the form of a diagrammatic depiction of a typical golfing hole to be used at a driving range or other practice area which is employed by its user for recording thereon the user's shot pattern established during the course of making various actual practice shots. The aid further includes directions for its use and a shot statistical tabulation to allow the user to summarize the user's performance in terms of shot quality which allows the golfer to identify and correct errors in his golf game (swing, grip, etc.).

The practice materials are preferably provided in booklet form consisting of a multitude of such golf hole diagrams and attendant statistical tabulations. Basic golfing tips are also preferably included in the booklet.

9 Claims, 3 Drawing Sheets

*THE PURPOSE OF THE BALLMARK™ PAD IS TO ASSIST THE GOLFER IN HITTING THE BALL STRAIGHTER AND MORE ACCURATELY BY CHARTING EACH PRACTICE SHOT AND BASED UPON BALL LOCATION, TO SPOT PROBLEM AREAS AND MAKE CORRECTIONS. THE PAD WILL ALSO SLOW YOUR PRACTICE A LITTLE, TENDING TO INCREASE YOUR FOCUS ON EACH SHOT AND LEAD TO A MORE PRODUCTIVE SESSION.*

DIRECTIONS

1. FILL OUT ALL INFO AT TOP OF PRACTICE SHEET– DATE, WEATHER, WIND, CLUB, ETC.
2. THE WATER HAZARD, BUNKER, TREES AND SHADED AREAS ON THE LEFT AND RIGHT SIDE OF THE FAIRWAY/GREEN ARE OUT OF BOUNDS. CONCENTRATE ON STAYING OUT OF THESE AREAS (STILL—BE SURE TO MARK YOUR SHOTS THAT GO THERE).
3. AT YOUR DRIVING RANGE OR PRACTICE AREA, SELECT TARGET OR AREA OF KNOWN DISTANCE AND HAVE THAT CORRESPOND TO THE PRIMARY TARGET (⊗) ON THE PRACTICE SHEET. THE PRIMARY TARGET IS CENTERED WITHIN THE SECONDARY TARGETS ( ) AND CAN BE ANY DISTANCE RELATIVE TO YOUR CLUB, YOUR POWER AND TYPE OF SHOT YOU ARE MAKING (I.E. 250± YARDS WITH A DRIVER).
4. THE RECTANGULAR SECONDARY TARGET SURROUNDING THE PRIMARY TARGET CAN BE USED FOR LONGER FAIRWAY OR TEE SHOTS. IT CAN BE ANY DIMENSION YOU DESIRE—SAY 40-45 YARDS WIDE AND 15-20 YARDS DEEP MIGHT BE GOOD WITH A FAIRWAY WIDTH OF 45-50 YARDS. A GOOD LONG TEE SHOT WOULD GO INTO THIS AREA, WITH GREAT SHOTS GOING ON THE HIGH SIDE OR BEYOND AND GOOD SHOTS MARKED ON THE LOW SIDE OR JUST BELOW.
5. THE CIRCULAR SECONDARY TARGET AREA, ALSO SURROUNDING THE PRIMARY TARGET, CAN BE A GREEN ABOUT 25-30 YARDS IN DIAMETER. YOU CAN HIT TO THIS AREA WITH ANY CLUB, BUT IT MIGHT BE PARTICULARLY GOOD FOR MOST IRONS, CHIP SHOTS, ETC. IF YOU DESIRE, MARK YOUR OWN CUP, CHANGE THE SHAPE OF THE GREEN OR ADD A BUNKER OR OTHER HAZARD TO FIT YOUR CONDITIONS.
6. THE NEXT PAGE IS A SAMPLE SHEET SHOWING 100 BALLS HIT TO A GREEN WITH A 5 IRON WITH A PRIMARY TARGET 160 YARDS DISTANT. REMEMBER TO SET THIS DISTANCE ACCORDING TO YOUR PERSONAL REQUIREMENTS.
7. THE REVERSE OF EACH SHEET HAS THE STATISTICAL BREAKDOWN OF YOUR PRACTICE SESSION. IT'S ALSO USEFUL IF YOU WANT TO KEEP UP WITH PERCENTAGES.

GOOD LUCK!

8. THE PAGES FOLLOWING THE SAMPLE SHEET INCLUDE A VERY GOOD LESSON THAT REVIEWS CRITICAL FUNDAMENTALS AND HAS THE NINE PRIMARY BALL FLIGHTS WITH APPROPRIATE CAUSE FOR THAT PARTICULAR FLIGHT. STUDY THIS – IT IS VERY USEFUL IN UNDERSTANDING AND CORRECTING ERRORS IN YOUR SHOT.

REMEMBER – THIS IS A GOOD GENERAL GUIDE FOR PRACTICE – FEEL FREE TO MAKE ANY ALTERATIONS TO FIT YOUR NEEDS.

FIGURE 2

FIGURE 3

YOUR STATS...

1. TOTAL NUMBER OF BALLS HIT..... _____

2. NUMBER OF BALLS IN TARGET AREA
   OR THAT YOU CONSIDER GOOD ..... _____
   *PERCENTAGE OF GOOD SHOTS*
   *(NO. 2 ÷ NO. 1)* ..... _____

3. NUMBER OF POOR SHOTS:

A. OUT OF BOUNDS LEFT..... _____
   *PERCENTAGE LEFT (NO. 3A ÷ NO. 1)* ... _____

B. OUT OF BOUNDS RIGHT..... _____
   *PERCENTAGE RIGHT (NO. 3B ÷ NO. 1)* _____

C. FAT SHOTS ..... _____
   *PERCENTAGE FAT (NO. 3C ÷ NO. 1)* .... _____

D. THIN SHOTS ..... _____
   *PERCENTAGE THIN (NO. 3D ÷ NO. 1)* _____

E. ANY OTHER POOR SHOTS ..... _____
   *PERCENTAGE OTHER (NO. 3E ÷ NO. 1)* _____

TOTAL POOR SHOTS..... _____
   *PERCENTAGE TOTAL POOR SHOTS*
   *(TOTAL POOR ÷ NO. 1)*..... _____

THINK POSITIVE ON THESE STATS, CONCENTRATE ON YOUR GAME AND INCREASE THE PERCENTAGE OF YOUR GOOD SHOTS.

PRACTICE NOTES:

GOLFWRITE STATISTICAL ANALYSIS

BACKGROUND OF THE INVENTION

The present invention pertains to the sport of golf and is concerned with providing a practicing and self teaching aid which primarily consists of printed and graphic materials compromising a diagrammatical sketch of a typical golf hole of a golf course to be used at a driving range or other practice area on which the user records the position of each practice shoe taken and the user's shot pattern subsequently tabulated and analyzed.

The game of golf is a very popular and demanding sport. Since it is a sport that can be played individually, and can be especially practiced individually, it is popular among participants of all ages in many places throughout the world. The sport attracts many people because at first blush, it appears to be a relatively easy sport. However, upon closer inspection and actual participation, it does not take long to realize that it is a difficult sport to master, and needless to say, practice is essential in order to become even an accomplished duffer. Without practice, the sport can become extremely frustrating and aggravating. For that reason, considerable books and practice aids have been introduced in the sport to aid golfers in perfecting their game. However, no product is known to exist that allows the golfer to record a series of practice shots with any given club and in any given practice area in order to identify any errors in the golfer's game. Practice or study aids that require the participant to think about and evaluate some of the more important parameters that must be coordinates on each type of shot have been found to be especially useful particularly for the less experienced golfer, because it is difficult when first learning the game, or only sparingly playing the game, to remember all of the more basic parameters that must be coordinated for any given shot. For example, a player's stance, grip, ball position, and alignment, among other things must be coordinated for each different type of shot. Among the advantages and features of the present invention is that it allows a golfer to record his shot pattern for a particular series of shots thereby with any club an, a, any practice area he can concentrate on one phase of the game at a time, that is, making a particular shot and concurrently record the results which he can then subsequently evaluate and analysis. That is, he need not attempt to perform all of these functions at once.

Among other advantages and features of the present invention is that the present book provides a rapid evaluation of the problems with the golfer's swing, stance, grip, et cet. Moreover, the present aid allows Coaches or professional instructors to home in on a problem immediately. This allows an instructor/coach to be more effective in improving the students game more rapidly. Additionally, the pad is adaptable to any practice area regarding distances, dimensions, conditions, and hazards as well as being adaptable to any golfing club. The present golfing aid also allows an instructor or coach to examine the practice periods of students and their progress between practice sessions by having a written record that is a more accurate reflection of a particular student's game because it has occurred over a number of practice sessions. It can also be appreciated by one skilled in the art that the present aid is adaptable to every club and that the pad can be altered to fit a particular layout or hole design.

SUMMARY OF THE INVENTION

The present invention comprises a golf practicing aid booklet or pad having a multitude of diagrammatical depictions of a hole or a part thereof of a typical golf course for use at a driving range facility or other practice area on which the user marks each practice shot he takes towards some position or target on the hole, e.g. a position down the fairway or on a green. The present booklet or pad includes directions for its use, as well as a statistical tabulation sheet. The latter allows the user to record the number of balls hit and to differentiate between good shots versus bad shots. With the present golfing aid, the user can practice a specific type of shot, and record the results which are subsequently evaluated and analyzed by virtue of the recorded shot pattern.

The present invention further provides written golf instructions involving the more common golfing parameters that need be mastered in order to play the sport efficiently.

A present objective of the invention is to provide the user a golf practicing device and apparatus which allows the user to record a multitude of different practice shots while concentrating on his swing whereby the shot pattern, established by virtue of the user's swing, can be recorded and subsequently evaluated and analyzed.

DESCRIPTION OF THE DRAWINGS

FIG. 2 of the drawings is a tabulation of the instructions for the use of the present golf practicing booklet.

FIG. 3 of the drawings is a tabulation outline whereby the user can tabulate and calculate the percentage of good shots versus bad shots.

DESCRIPTION OF THE PREFERRED EMBODIMENT

Figure 1:
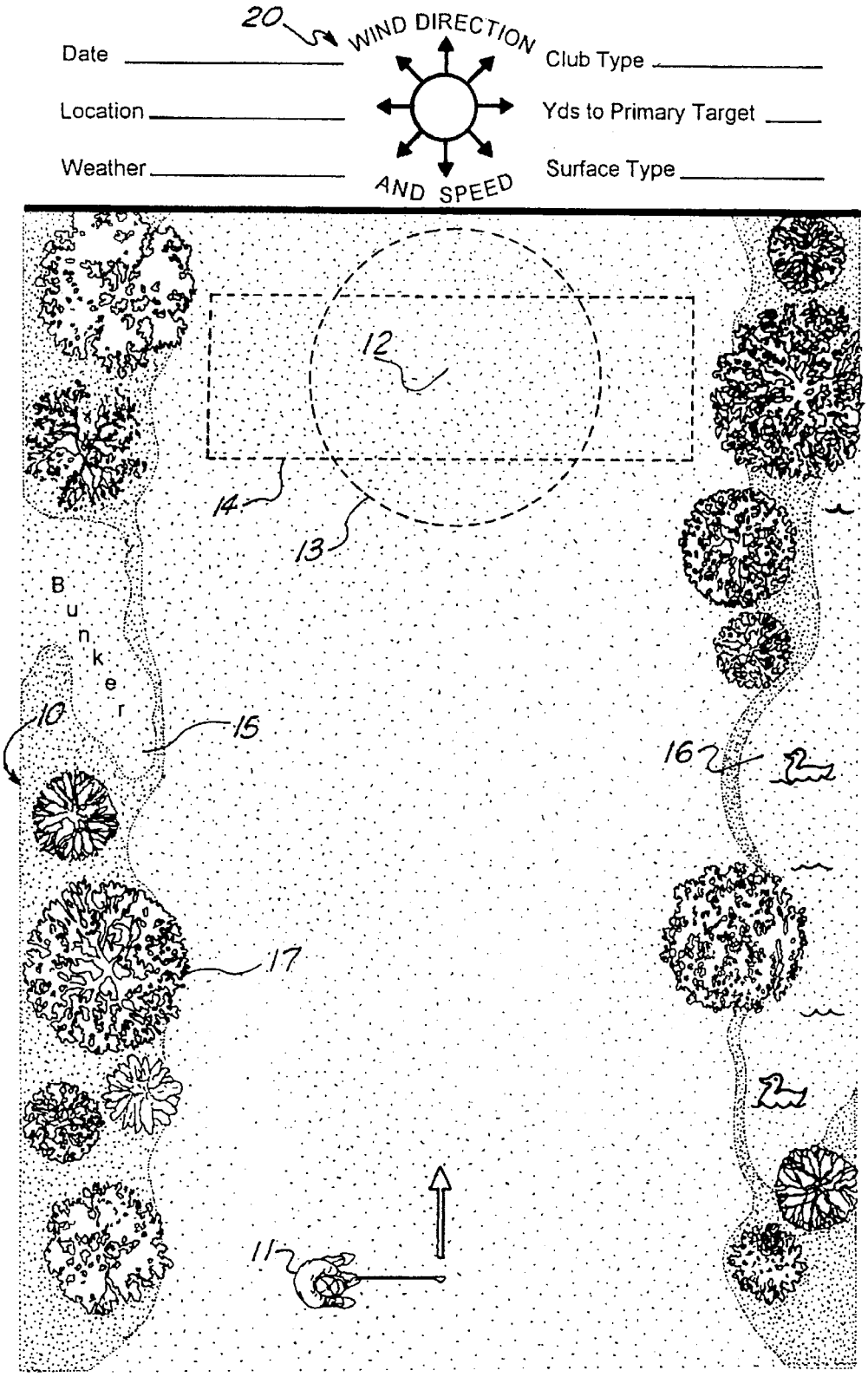
FIG. 1 of the drawings is a diagrammatical plan view of a typical fairway or green on a typical golf course to be used at a practice area showing the position of the user taking a shot toward a particular location or target on the hole on which graphic representation the user records various practice shots with a given club.

FIG. 1 of the drawings depicts the essential indicia of the present invention which in essence constitutes the graphic representation of a golf hole or a portion thereof, e.g., a fairway, green, cup or pin, or hazards of a typical golf course. Reference numeral 10 of FIG. 1 represents a practice area which is a reproduction of a fairway or green forming part of a golf course. The user 11 is shown in position on the fairway or in a tee box making a shot toward the marked area that is an ideal location or target 12 which can either be a position on the fairway or the pin or cup on a green. This can comprise either the circular portion 13 which represents a green with 12 being the cup or pin or the rectangular portion 14 which represents an ideal area on the fairway. The golfer determines all of this by selecting objects or areas of known distance and size at his practice area. The latter areas 13 and 14 can also be construed as a zone within which the user 11 is attempting to consistently hit a golf ball within, such as the good in-play area on a fairway that a tee shot or other fairway shot to the pin 12. The portion 10 of a golf hole includes various other graphic indicia typifying it as a golf hole or fairway, e.g. the bunker 15 on the left, the water hazard 16 on the right, and the various trees 17. Of course, it can be appreciated by one skilled in the art that the portion 10 of the hole arrangement shown can be illustrated in different manners, e.g. a hole having a dog-leg to the left or right, or having a bunker 15 or a water hazard 16 immediately across the path of flight of the ball hit by the user 11 toward the spot or target 12, viz. it is adaptable to different layouts.

FIG. 1 further comprises the written indicia 20 above the portion 10 which allows the user to record the wind direction and speed, the date of the practice section, the practice site, the weather conditions, the type of club employed, the number of yards to the primary target 12 from the position of the user 11 shown in the portion 10, and the type of surface the practice shots were hit from or landing on.

FIG. 2 of the drawings is a tabulation of directions for utilizing the present golf practice booklet or pad. The directions in paragraphs 4 and 5 thereof describe the particular function of the indicated shot areas 13 and 14. The shot area in 13 would typically comprise a green about 25–30 yards in diameter which would be approached primarily with an iron. Whereas, the rectangular area 14 would typically be a target 40–45 yards wide and 15–20 yards deep laying on a fairway which typically would be approached with a wood club.

FIG. 3 of the drawings comprises a tabulation of the results of the user's shot pattern. For one, the user would record a total number of balls hit. In paragraph 2, the user would record the number of balls hit in a selected target area or that which the user considers to be good shots. By dividing the number of balls hit within the target area by the total number of balls hit, the user would arrive at the percentage of good shots. In paragraph 3, the various types of poor shots are recorded, specifically, in subparagraph A, the number of out of bound shots to the left; in subparagraph B, the number of out of bound shots to the right; in subparagraph C, the number of fat shots; in subparagraph D, the number of thin shots, and in subparagraph E, any other poor shots. Of course, the percentage of each is derived as instructed in FIG. 3. The user would then total up the number of poor shots and calculate the number of poor shots taken.

As pointed out above, a distinct advantage of the present invention is that the user can record a complete pattern of practice shots taken which can then subsequently be evaluated and analyzed. In the meanwhile, the user can concentrate on the critical fundamentals that part time golfers or amateurs must do to play a decent round of golf. Of course, someone who plays considerable golf, especially a professional, executes a lot of these fundamentals automatically without thinking about it. On the other hand, an amateur must constantly review in his mind these fundamentals. The present invention allows the user to record various golf shots without trying to subsequently recall them from his memory and then analyze what he may have been doing wrong in making that particular shot. The user can either take a multitude of practice shots employing what the user thinks is the manner of executing the critical fundamentals and thereafter subsequently review the recorded pattern of golf shots to determine what particular fundamental was not being employed or followed. Another distinct advantage of the present invention, is that it not only allows the user to record his pattern of practice shots and personally evaluate his performance at a later time, but additionally, gives him a recorded history of such shots which he can subsequently discuss with others, e.g. an instructor who would be able to shed some light on the user's problems. Yet another advantage of the present invention is that every visual aid an amateur golfer can add to the perfection of his game generally makes it easier for the golfer to subsequently analyze and improve his game. Merely trying to go back and remember what you might have done wrong on a particular shot is extremely difficult, and in any event, makes it impossible to subsequently confer with an expert to ascertain exactly what you did do wrong on a particular shot. Thus, it becomes apparent that the present golfing aid is primarily designed for making a series of practice shots.

It would be apparent to one skilled in the art that many changes can be made to the basic inventive concept disclosed herein without departing from the true scope and spirit of the present invention. For example, the position of various hazards shown in FIG. 1 of the drawings can be varied as well as the target areas. Additionally, the location of the written indicia portion 20 can be relocated. Moreover, the instructions of FIG. 2 of the drawings can be varied. Additionally, the statistical tabulation shown in FIG. 3 of the drawings can be varied without departing from the true scope and spirit of the present invention. Last but not least, as pointed out above, the present golf practice booklet or pad preferably includes a series of illustrated critical golf fundamentals as well as primary ballflights that occur depending upon variations in following such critical golf fundamentals. A set of causes accompanies each ball-flight to explain to the use, what fundamental may have been violated assuming said ballflight pattern was not desired to start with. A given ballflight that is not desired would depend upon violation of one or more critical fundamentals, such as grip, ball position, open stance, and so forth. The most preferred embodiment of the present invention comprises a pad of the present diagrammatical golf course hole arranged in a conventional stenographic size 6×10 inch wire bound booklet comprising a multitude of FIG. 1 diagrams with the FIG. 3 statistical tabulation printed on the back thereof. The pad would also preferably include the FIG. 2 instructions and a sample FIG. 1 shot pattern embodied on the first few pages followed by critical fundamental illustrations, such as grip, stance, and so forth and typical ballflight patterns following such fundamentals which precede a multitude of FIG. 1 printed and graphic indicia materials.

In light of the above, it can be appreciated by one skilled in the art that many varying different embodiments can be made within the scope of the present inventive concept, and accordingly, it is to be understood that the details of the present concept are to be interpreted as illustrative and not in a limiting sense. Therefore, what is intended to be encompassed within the ambit of the present invention is that as set forth and particularly pointed out in the appended claims.

I claim:

1. Golf practicing aid means for aiding a user in developing their golf swing, comprising a markable substrate depicting a diagrammatical layout of a golf hole including hazards graphically depicted thereon, on which substrate a user can mark practice golf shots with reference to a target area graphically depicted thereon, said golf practicing aid means further comprising a statistical tabulation markable substrate on which the user inscribes the number of good shots within a target area and the number of poor shots, whereby the user can then calculate the percentage of good shots versus poor shots, said statistical tabulation markable substrate further comprising poor shot indicia, setting forth a breakdown of categories of poor shots, said poor shot indicia arranged to enable a user to indicate on said statistical tabulation markable substrate the number of poor shots in each of said categories, and thereby discern particular areas of weakness in said user's golf swing.

2. The golf practicing aid means of claim 1 further characterized in that a multitude of markable substrates are combined in the form of booklet means.

3. The golf practicing aid means of claim 2 further characterized in that said booklet means includes illustrated critical fundamental golfing instructions.

4. The golf practicing aid means of claim 2 further characterized in that said booklet means includes illustrated ballflight analyses.

5. The golf practicing aid means of claim 1 further characterized in that said markable substrate is further defined as depicting a target area comprising a rectangular area having a specific target point therein and a circular area superimposed thereon representing a green whereby the specific target point represents a pin so that the user can record either practice fairway shots or green shots.

6. The golf practicing aid means of claim 1 further characterized in that said markable substrate is further defined as having a portion thereon for recording pertinent information such as the date, location, weather, wind direction, club type, yards to primary target, and surface type.

7. The method of aiding a user in developing a golf swing, comprising the steps of:

a. providing in booklet form, a markable substrate depicting a diagrammatical layout of a golf hole including hazards graphically depicted thereon, on which substrate a user can mark practice golf shots with reference to a target area graphically depicted thereon, said golf practicing aid means further comprising a statistical tabulation markable substrate on which the user inscribes the number of good shots within a target area and the number of poor shots, whereby the user can then calculate the percentage of good shots versus poor shots, said statistical tabulation markable substrate further comprising poor shot indicia, setting forth a breakdown of at least two categories of poor shots, said poor shot indicia arranged to enable a user to indicate on said statistical tabulation markable substrate the number of poor shots in each of said categories, and thereby discern particular areas of weakness in said users golf swing;

b. practicing striking golf balls at a target, comprising the further steps of:

i. striking a first golf ball at a target area having a target point;

ii. discerning the end location of said struck first golf ball relative to said target point;

iii. visualizing said target point as said golf hole on said diagrammatical layout of said markable substrate, marking on said markable substrate the approximate location of said first golf ball relative to said target point;

iv. striking an other golf ball at a target area having a target point;

v. discerning the end location of said other struck golf ball relative to said target point;

vi. visualizing said target point as said golf hole on said diagrammatical layout of said markable substrate, marking on said markable substrate the approximate location of said other golf ball relative to said target point;

vii. repeating steps iv–vi until the desired amount practice has been achieved, generating various marks on said diagrammatical layout of said markable substrate;

c. reviewing the various marks generated during steps i–vii on said markable substrate, determining the positions of said various marks relative to said golf hole, and the locations of said various marks relative to said target area of said diagrammatical layout;

d. inscribing on said statistical tabulation markable substrate the number of shots within a target area, and the number of shots outside of the target area;

e. thereby calculating the percentage of good shots versus poor shots;

f. discerning the locations of said poor shots relative to the target area, determining a poor shot pattern;

g. utilizing said poor shot pattern to adjust said user's golf swing, thereby improving upon said user's golf swing.

8. The method of claim 7, wherein there is further provided in step "f" the additional step of breaking down said poor shot pattern into locational categories, and indicating on said statistical tabulation markable substrate the number of poor shots in each of said categories.

9. The method of claim 7, wherein in step "f" there is provided the additional step of providing critical fundamental golfing instructions associated with said markable substrate, and there is further provided in step "g" the additional step of referring to said critical fundamental golfing instructions, in conjunction with said poor shot pattern, in order to diagnose a weakness in said user's golf swing, and there by adjust said user's golf swing.

* * * * *